United States Patent [19]

Lopez

[11] Patent Number: 4,637,383

[45] Date of Patent: Jan. 20, 1987

[54] TOXIC ENVIRONMENTAL BREATHING HOOD

[75] Inventor: Edward L. Lopez, Newhall, Calif.

[73] Assignee: Lockheed Corporation, Calabasas, Calif.

[21] Appl. No.: 812,499

[22] Filed: Dec. 23, 1985

[51] Int. Cl.[4] ..... A62B 7/00

[52] U.S. Cl. ..... 128/201.25; 2/7

[58] Field of Search ..... 128/201.25; 2/5, 7, 2/8

[56] References Cited

U.S. PATENT DOCUMENTS

| | | | |
|---|---|---|---|
| 2,810,386 | 10/1957 | Reed | 128/142 |
| 2,850,011 | 9/1958 | Schaefer | 128/142 |
| 4,046,939 | 9/1977 | Hart | 428/311 |
| 4,231,118 | 11/1980 | Nakagawa | 128/201.25 |
| 4,297,117 | 10/1981 | Holter et al. | 55/389 |
| 4,382,440 | 5/1983 | Kapp et al. | 128/201.25 |
| 4,523,588 | 6/1985 | Dolsky | 128/201.25 |
| 4,583,535 | 4/1986 | Saffo | 128/201.25 |

FOREIGN PATENT DOCUMENTS

| | | | |
|---|---|---|---|
| 857420 | 4/1940 | France | 128/201.25 |
| 67291 | 6/1978 | Japan | 128/201.25 |

*Primary Examiner*—Henry J. Recla
*Attorney, Agent, or Firm*—Louis L. Dachs

[57] ABSTRACT

The invention is a breathing hood assembly for protecting a person from a fire and toxic gases produced therefrom. The invention comprises a fire resistant hood of a sufficient size so as to fit over the person's head. The hood has a neck portion including a drawstring or elastic for sealing the hood to the neck of the person. The interior surface of the neck portion is lined with a silica gel and barium oxide impregnated cloth. A transparent window is mounted to the hood extending about the periphery thereof. A filter is mounted to the hood which extends about the periphery thereof and is in communication with the interior of the hood. The filter includes an inner sodium bisulfate impregnated cloth layer and an outer fire resistant cloth cover. The outer fire resistant cloth cover is joined at its edges to the edges of the inner cloth layer forming a donut shaped cavity. A donut shaped cloth bag impregnated with silica gel and barium hydroxide is mounted within the cavity. The cavity is filled with a flexible polyurethane foam. The polyurethane foam is impregnated with activated charcoal, micro pumice stone particles coated with caustic soda and a compound of manganese dioxide and copper oxide.

3 Claims, 2 Drawing Figures

FIG. 1
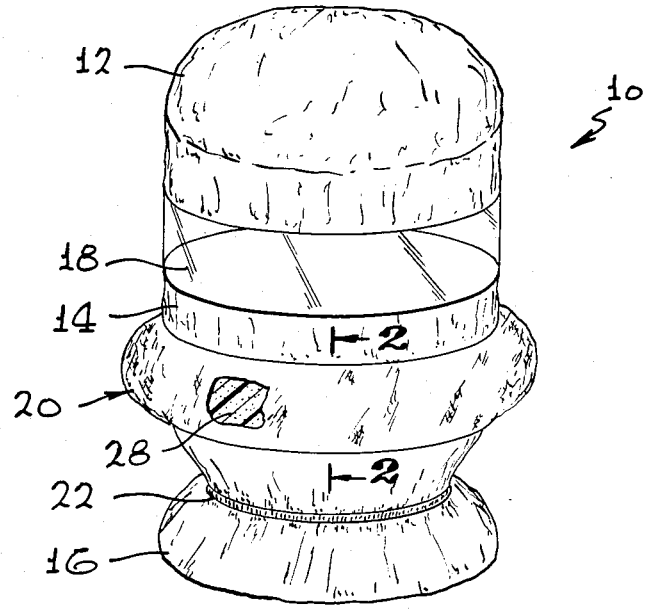
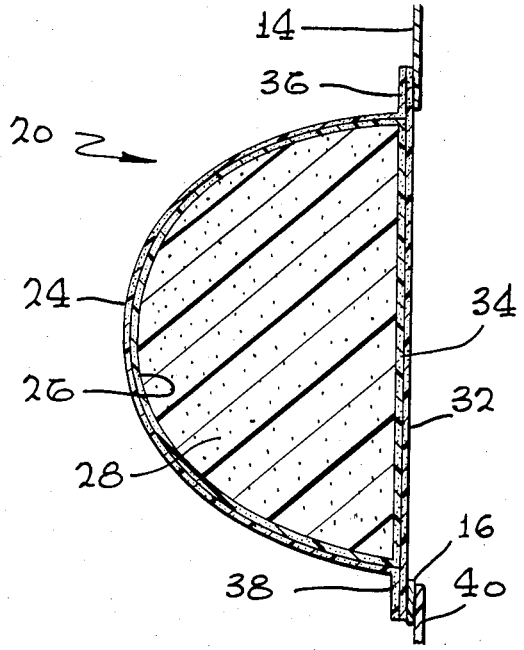
FIG. 2

TOXIC ENVIRONMENTAL BREATHING HOOD

TECHNICAL FIELD

This invention relates to the field of breathing apparatus and, in particular, to a compact lightweight personal emergency breathing hood for use on an airplane.

BACKGROUND INFORMATION

In a fire, the victims are not only subjected to the flames but also to a multitude of noxious gases. Eighty percent of the deaths due to such fires are caused by noxious gas inhalation. In order to survive the toxic environment associated with fires, victims need to reach breathable air or a smoke mask in one to four minutes.

A typical smoke mask arrangement is shown in U.S. Pat. No. 2,810,386 entitled "Oxygen Masks Embodying Means for Ventilating Goggles" by W. B. Reed. Commonly used smoke mask filter materials are disclosed in U.S Pat. No. 4,046,939 entitled, "Gas Resistant Foam Materials" by Hart. Polyurethane foam impregnated with activated carbon particles is used. The foam is highly resistive to the passage of noxious gases and the carbon particles adsorb various noxious gases.

The need to adsorb specific noxious gases was recognized in U.S. Pat. No. 4,297,117 entitled, "Respiratory Device for Catastrophic Fires and/or Smog Weather Conditions" by Holter et al. The patent discloses the use of adsorptive materials such as: cuprous oxide, manganese dioxide, calcium aluminum-silicate, soda lime and activated carbon.

Because fires are often associated with a low visibility environment due to smoke and loss of lighting, smoke masks made entirely of transparent plastic have been made, for example as illustrated in U.S. Pat. No. 2,850,011 entitled, "Respiratory Helmet" by Schaefer. The transparent mask affords maximum vision therethrough and is readily positionable. The mask uses an oxygen canister to supply breathable air.

Therefore, an object of the present invention is to provide a compact, lightweight breathing hood which is readily positionable.

A further object of the present invention is to provide a breathing hood which provides good visibility and maximum noxious gas protection.

A further object of the invention is to also provide a breathing hood which provides head, neck and face thermal protection from a fire.

DISCLOSURE OF THE INVENTION

The invention is a breathing hood assembly for protecting a person from a fire and toxic gases produced therefrom. The invention comprises a fire resistant hood of a sufficient size so as to fit over the person's head. The hood has a neck portion including means for sealing the hood to the neck of the person. The hood is preferably made of 1 mil thick nylon scrim reinforced aluminized high temperature polyimide film. The interior surface of the neck portion is lined with a silica gel and barium oxide impregnated cloth. A transparent window is mounted to the hood extending about the periphery thereof and preferably is coated on the interior surface with an anti-fog coating. A filter is mounted to the hood also extending about the periphery thereof and in communication with the interior of the hood.

The filter comprises an inner sodium bisulfate impregnated cloth layer. An outer fire resistant cloth cover is joined at its edges to the edges of the cloth layer forming a donut shaped cavity. A donut shaped cloth bag impregnated with silica gel and barium hydroxide is mounted within the cavity. The cavity is filled with a flexible polyurethane foam. The polyurethane foam is impregnated with activated charcoal (SORBACEL), micro pumice stone particles coated with caustic soda and a compound of manganese dioxide and copper oxide (HOPCALITE).

The novel features which are believed to be characteristic of the invention, both as to its organization and method of operation, together with further objects and advantages thereof, will be better understood from the following description in connection with the accompanying drawings in which the presently preferred embodiment of the invention is illustrated by way of example. It is to be expressly understood, however, that the drawings are for purposes of illustration and description only and are not intended as a definition of the limits of the invention.

BRIEF DESCRIPTION OF THE DRAWINGS

FIG. 1 illustrates a front view of the breathing hood.

FIG. 2 shows a cross-sectional view of the hood shown in FIG. 1 taken along the line 2—2.

BEST MODE FOR CARRYING OUT THE INVENTION

Referring to FIG. 1, there is shown a front view of a breathing hood assembly 10 constructed in accordance with the teachings of the subject invention. The top portion 12, central portion 14 and neck portion 16 are preferably constructed of 1 mil thick nylon scrim reinforced aluminized high temperature polyimide film such as (KAPTON). Portions 12, 14 and 16 being aluminized for maximum heat reflection provide the overall fire resistance of the breathing hood assembly 10. The neck portion 16 contains a conventional drawstring assembly for securing the hood about the neck to prevent toxic gases from entering the interior of the hood once installed. Interposed between the top portion 12 and the central portion 14 is a fully circular viewing portion 18 preferably made of transparent polyimide film such as (KAPTON). The interior of viewing portion 18 is coated with a commercially available antifogging layer such as Spray-on Anti-fog Coating containing silicones or waxes made by Dow Chemical Company or General Electric Company. The antifog coating prevents fogging due to exhalation.

Interposed between central portion 14 and the neck portion 18 is a fully circular porous adsorbant filter band 20 which is discussed in detail with regard to FIG. 2. The neck portion 16 of the breathing hood assembly 10 is adapted to a wearer's neck via an elastic or drawstring 22. This provides a failsafe neck seal against a toxic environment.

FIG. 2 illustrates a cross-section of the fully circular porous adsorbant filter band 20. The filter band 20 includes an exterior porous fiberglass (PBI) or (CELIOX) cloth cover 24, which provides overall fire resistance, filters large smoke particles and retains the interior adsorbants. Disposed on the interior side of the cloth cover 24 is a donut shaped cloth bag 26 impregnated with silica gel and barium hydroxide. The cloth bag 26 encloses a fire retardant flexible polyurethane foam 28 containing a plurality of absorbants. The cloth bag 26 adsorbs incoming water moisture and carbon dioxide from combustion gases or exhaled air, so that the adsorbants in the foam are not degraded.

The foam 28 is impregnated with active charcoal particles for example (SORBACEL) which adsorbs small smoke particles and hydrocarbon combustion gases. The foam 28 is further impregnated with a (HOPCALITE) compound of 60% manganese dioxide and 40% copper oxide particles. This (HOPCALITE) compound adsorbs carbon monoxide (CO) gas. The foam 28 is also impregnated with micropumice stone particles coated with caustic soda (NaoH) to adsorb acid gases such as: HF, HCl, $CO_2$, HCN, $NO_2$, $H_2S$, HBr, $Cl_2$, Br, and $SO_2$.

The foam is impregnated with the SORBACEL, HOPCALITE and micropumice stone particles by immersing the foam into a container filled with liquid sodium silicate having the mixture of the three particles dispersed therein and then squeezing the excess sodium silicate out. This step can be repeated as necessary. Thereafter, the foam is allowed to dry. The sodium silicate acts as a binder holding the mixture of particles in place.

A sodium bisulfate impregnated cloth layer 32 is joined to the interior portion 34 of the cloth bag 26 for adsorbing formaldehyde (HCHO) and other aldehydes. The cloth layer 32 and cloth cover 24 are heat sealed to central portion 14 at junction 36 and to the neck portion 16 at junction 38. The interior surface of neck portion 16 is lined with a silica gel and a barium oxide impregnated cloth 40 to adsorb exhaled $H_2O$ and $CO_2$.

The breathing hood 10 is capable of protecting both adults and children. It folds into a package approximately 3 inches by 6 inches by 1 inch and weighs approximately 5 ounces. Because the breathing hood assembly 10 is compact and lightweight, it may easily be stowed, for example, in the overhead compartment in an aircraft passenger service module. In the stowed condition, the hood polyimide film (portions 12, 14 and 16) surrounds the filter band such that the adsorbants are not degraded until ready to use. Upon an imminent fire condition, such as at the start of an on board fire, the crew deploys the package and the passengers can be directed to quickly undo the package and don the hood. Since the circular window and filter make the hood non-directional, this is a great advantage in the dark or in any panic situation. Furthermore, because the filter is porous, communications to and from the wearer are not adversely affected. A tight neck elastic or drawstring provides a nearly 100% seal against practically all known irritating and/or toxic gases produced by combustion.

While the invention has been described with reference to a particular embodiment it should be understood that the embodiment is merely illustrative as there are numerous variations and modifications which may be made by those skilled in the art. Thus, the invention is to be construed as being limited only by the spirit and scope of the appended claims.

I claim:

1. A breathing hood assembly for protecting a person from a fire and toxic gases produced, therefrom comprising:

a hood of fire resistant, gas impervious material sufficiently sized so as to fit over the person's head, said hood having a neck portion including means for sealing the hood to the neck of the person, the interior surface of said neck portion lined with a silica gel and barium oxide impregnated cloth;

a transparent window mounted to said hood extending about the periphery thereof; and, a filter mounted to said hood extending about the periphery thereof, said filter in communication with the interior of said hood, said filter comprising:

an inner sodium bisulfate impregnated cloth layer secured at its edges to and annular opening extending around the periphery of said hood;

an outer fire resistant cloth cover joined at its edges to the edges of said inner cloth layer, said inner and outer cloth layers forming a donut shaped cavity;

a donut shaped cloth bag impregnated with silica gel and barium hydroxide lining said cavity and, a flexible polyurethane foam filling said cavity, said polyurethane foam impregnated with activated charcoal, micro pumice stone particles coated with caustic soda, and a compound of manganese dioxide and copper oxide.

2. The hood assembly of claim 1 wherein compound of manganese dioxide and copper oxide are in a 60% to 40% ratio.

3. The hood assembly of claim 2 wherein the interior of said window is coated with an anti-fog coating.

* * * * *